US008016514B2

(12) United States Patent
Broadway, III

(10) Patent No.: US 8,016,514 B2
(45) Date of Patent: Sep. 13, 2011

(54) ASPHALT REPAIR METHOD

(75) Inventor: Johnnie B. Broadway, III, Hamtramck, MI (US)

(73) Assignee: Johnnie B. Broadway, III, Carson City, NV (US)

( * ) Notice: Subject to any disclaimer, the term of this patent is extended or adjusted under 35 U.S.C. 154(b) by 1687 days.

(21) Appl. No.: 10/173,937

(22) Filed: Jun. 18, 2002

(65) Prior Publication Data

US 2003/0026652 A1 Feb. 6, 2003

Related U.S. Application Data

(60) Provisional application No. 60/298,870, filed on Jun. 18, 2001.

(51) Int. Cl.
*E01C 7/00* (2006.01)

(52) U.S. Cl. ..... 404/75

(58) Field of Classification Search ..... 404/75, 404/82

See application file for complete search history.

(56) References Cited

U.S. PATENT DOCUMENTS 2,134,357 A * 10/1938 Conzelman ..... 427/139
3,112,681 A * 12/1963 Gessler et al. ..... 404/31
3,601,016 A * 8/1971 Ploeg et al. ..... 404/75
3,741,856 A * 6/1973 Clarke ..... 442/150
3,925,582 A * 12/1975 Sample et al. ..... 427/385.5
3,993,412 A * 11/1976 Drane ..... 404/28
4,302,128 A * 11/1981 Thatcher ..... 404/111
4,392,335 A * 7/1983 Heiman ..... 52/309.17
4,781,490 A * 11/1988 Jelling ..... 404/75
4,822,425 A * 4/1989 Burch ..... 106/273.1
4,915,539 A * 4/1990 Yoshikane et al. ..... 404/31
4,948,431 A * 8/1990 Strickland et al. ..... 106/273.1
5,263,790 A * 11/1993 Bickley et al. ..... 404/107
5,630,677 A * 5/1997 Barroso ..... 404/75
5,749,674 A * 5/1998 Wilson, Sr. ..... 404/75
6,074,128 A * 6/2000 Marino ..... 404/75
6,217,252 B1 * 4/2001 Tolliver et al. ..... 404/77

OTHER PUBLICATIONS

U.S. Department of Transportation, Federal Highway Administration, TECHBRIEF "Pothole Repair", FHWA-RD-99-202, Nov. 1999.*

* cited by examiner

*Primary Examiner* — Gary S Hartmann

(57) ABSTRACT

A method for patching or repairing a hole in a road surface is defined by filling the hole and the area of the road surface about the hole with an oil-based adhesive, which is used to adhere a quantity of patching asphalt which is placed into the hole and into the area surrounding the hole having the adhesive applied thereto. After the asphalt is compressed or packed into the hole and into the surrounding area above the hole, a layer of sand is then applied thereover, which is, also, subsequently compressed into the asphalt to fill the pores thereof.

4 Claims, 2 Drawing Sheets

FIG 1
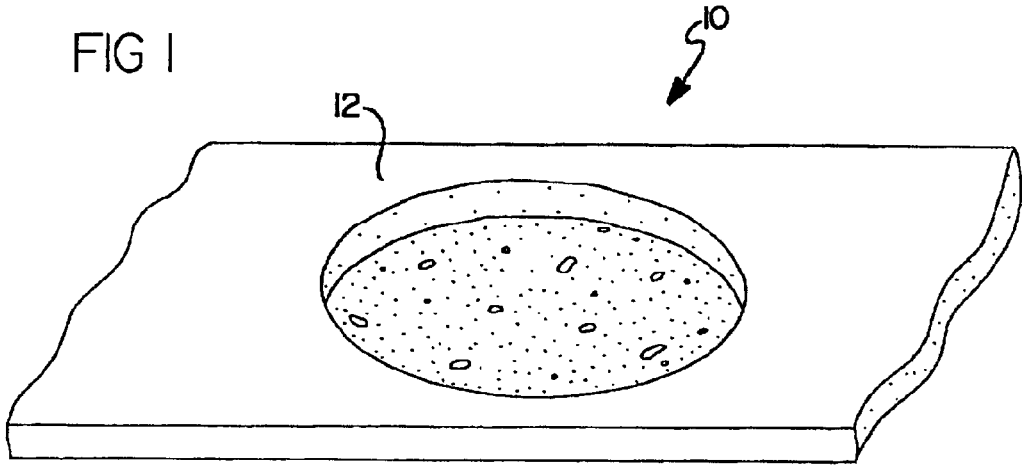
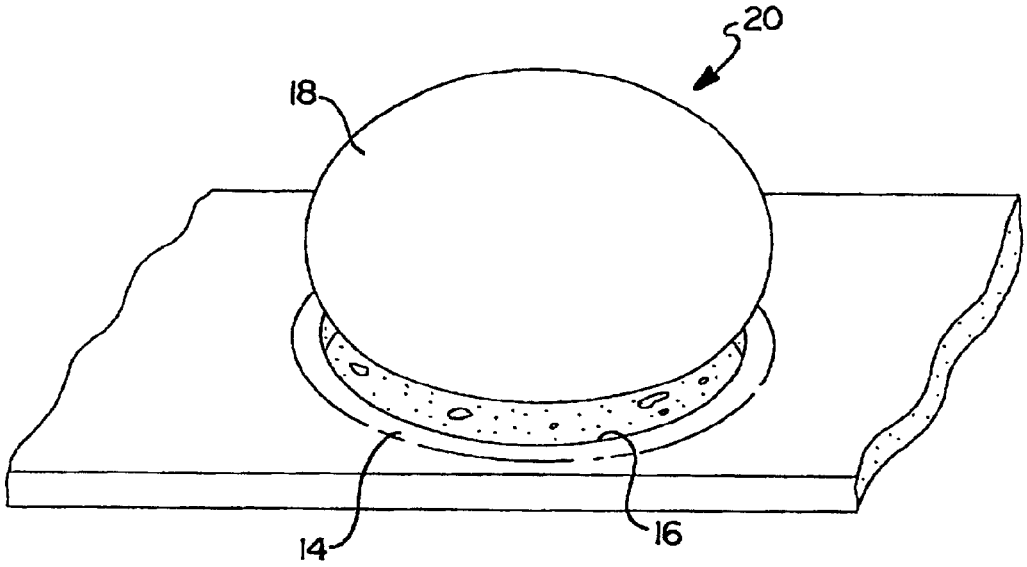
FIG 2

FIG 3
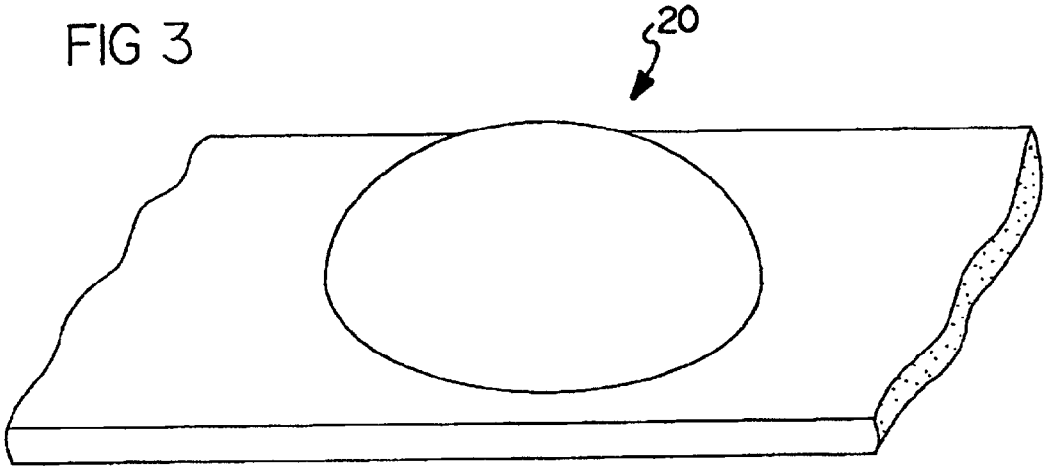
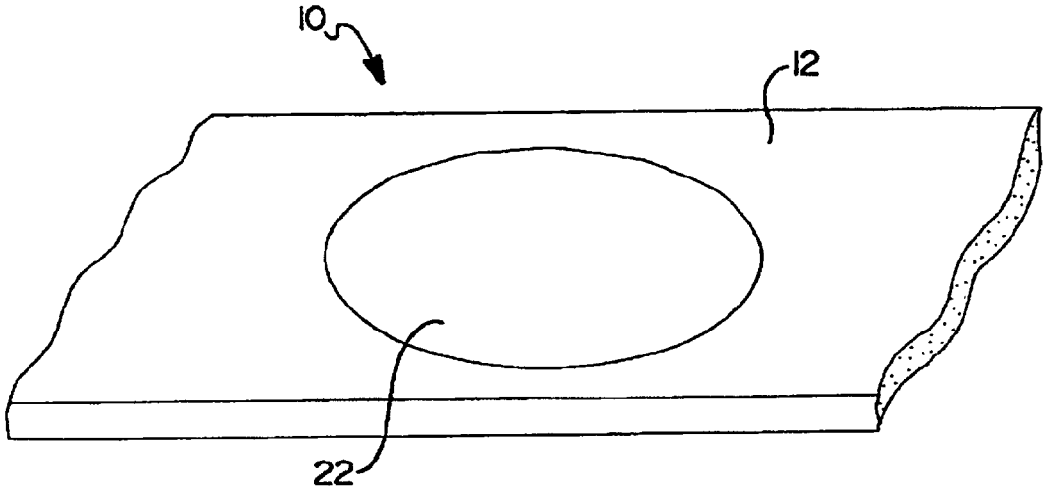
FIG 4

ASPHALT REPAIR METHOD

CROSS-REFERENCE TO RELATED APPLICATIONS

This application is a completion patent application of U.S. Patent Provisional Application No. 60/298,870, filed Jun. 18, 2001, for "Broadway Method", the disclosure of which is hereby incorporated by reference.

BACKGROUND OF THE INVENTION

1. Field of the Invention

The present invention pertains to road construction. More particularly, the present invention pertains to road repair. Even more particularly, the present invention pertains to means and methods for repairing cracks and holes in asphalt roads.

2. Description of Prior Art

As is known to those skilled in the art to which the present invention pertains, one of the on-going problems encountered with asphalt or other bitumen-based roads is the creation of holes, potholes, cracks and the like. This is due to climatic conditions such as heat expansion and cold contraction, hot and cold cycles, etc. Furthermore, in snow and ice, when salt or other materials are placed on the road for ice melting, there is seeping into the asphalt pores and causes erosion of the asphalt, again damaging the road. The "potholes" have to be repaired in a timely manner, lest vehicles be damaged by running through them.

Typically, holes and cracks in asphalt are repaired by emplacing within the hole patching materials, such as more asphalt, which materials are mixed with an adhesive, which is water-soluble, including epoxy adhesive, as well as other materials. However, because the patching material and the method of patching is substantially identical to the asphalt mixture itself, the repair itself is not durable.

The present invention as will be subsequently detailed, seeks to alleviate this problem in the prior art by providing an improved method of repairing holes in asphalt roads that is durable and lasts for an extended period of time.

SUMMARY OF THE INVENTION

In accordance with the present invention there is provided a method for repairing holes, crevices and other openings in an asphalt road which generally comprises:

a. removing any debris from the opening;
b. placing a quantity of an oil-based adhesive in the opening and on the asphalt surrounding the opening;
c. depositing a quantity of asphalt in the opening and on the adhesive on the asphalt about the periphery of the opening to create a mound;
d. packing the asphalt down into the hole and onto the peripheral area;
e. applying a quantity of sand over the packed-down asphalt mound;
f. packing the sand down into the packed asphalt; and
g. thereafter removing any excess sand.

The packing is done with conventional road construction tampers and/or rollers, such as steam rollers and the like. This creates sufficient pressure on the mound of asphalt, as well as the sand, in order to level out the material and to make it substantially contiguous with the road.

It is contemplated that conventional silicon dioxide sand, such as that found along ocean fronts, beaches and the like, be used herein. This enables a color change to be observed such that the sand will turn from its typical beige or off-white color to a white.

The sand is used to fill the pores in the asphalt to render it more impervious to climatic conditions, salt, gasoline, oil, etc., as well as the expansion and contraction thereof due to excessive heat and cold. The sand renders the patch more durable.

For a more complete understanding of the invention, reference is made to the following detailed description and accompanying drawing.

BRIEF DESCRIPTION OF THE DRAWINGS

In the drawing like reference characters refer to like parts throughout the several views in which:

FIG. 1 is a broken, partial perspective view of a typical pothole in asphalt;

FIG. 2 is a partial perspective exploded view showing the filling of the hole;

FIG. 3 is a partial perspective view showing a mound of asphalt thereon; and FIG. 4 is a partial perspective view showing the finished repaired hole.

DETAILED DESCRIPTION OF THE PREFERRED EMBODIMENTS

Now, and in accordance herewith, there is provided a method for repairing an opening, such as a hole, crack or crevice in an asphalt or similar type road which, generally, comprises:

a. removing any debris from the opening;
b. placing a quantity of an oil-based adhesive in the opening and on the asphalt surrounding the opening;
c. depositing a quantity of asphalt in the opening and on the adhesive on the asphalt about the periphery of the opening to create a mound;
d. packing the asphalt down into the hole and onto the peripheral area;
e. applying a quantity of sand over the packed-down asphalt mound;
f. packing the sand down into the packed asphalt; and
g. thereafter removing any excess sand.

With more particularity, and as shown in the drawing, there is an asphalt road generally denoted at 10 having a pothole or similar opening, crack or crevice created therein through typical wear and tear on the road and which is generally denoted at 12. In accordance with the present invention, the opening 12 is repaired by first removing any residual debris from the opening. This can be done effectively either manually or through a source of air or the like which is typically provided at a road repair scene. An air hose connected to a source of compressed air is commonly available to effectuate this. However, manual cleaning with a broom, shovel or the like can be used. What is critical hereto is that the opening be freed from any residual debris.

In practicing the present invention, the peripheral area 14 about the opening 12 and having a circumference of about 2 to about 10 inches, and, preferably, 4 to 8 inches, is, also, rid of any debris therefrom. Thereafter, a quantity or layer 16 of an oil-based adhesive is deposited both within the hole as well as on the surrounding area 14 about the hole or opening on the asphalt. It is critical hereto that the adhesive be an oil-based adhesive. Oil-based adhesives are well known and commercially available, and are either products from a petroleum or a natural oil in which an adhesive, such as styrene, is incorporated into the material. Thus, castor oil, soy and other oil-based adhesives can be used herein.

The oil-based adhesive is a liquid which can be applied through any suitable means such as with a roller, broom or the like. As noted, a layer or quantity of the adhesive 16 is spread around the perimeter 14 of the hole 12 as well as in the hole itself in a sufficient enough quantity to enable a quantity of asphalt in contact therewith to be adhered thereto.

After the adhesive 16 is applied to the road surface, as well as in the hole 12, a quantity 18 of asphalt is deposited both within the hole and into and around the surrounding area 14. Preferably, a mound 20 of asphalt that extends from about 2 to about 12 inches above the hole and into the surrounding area 14 is created. Preferably, the mound is from about 6 to about 10 inches in height above the road.

Thereafter, conventional road repair equipment, such as a tamper or roller, either manual or mechanically-operated, is then brought into contact with the mound 20 and it is packed down into the hole 12 and into the area 14 about the hole. This is done until the mound of asphalt is packed and tamped down to the point where it is substantially contiguous with the road as shown in FIG. 4.

After the asphalt is packed down a quantity of sand 22 is spread over the flattened mound. Preferably, the quantity of sand will be just sufficient to cover the asphalt. After the sand is emplaced over the asphalt, a roller or tamper, of the type described hereinabove is then used to pack the sand into the asphalt. Ordinarily, because the sand of the type contemplated is that usually found at a beach or the like with its typical beige or brown silicon dioxide composition, under pressure, the sand will fill the pores in the asphalt and turn white. Once the sand is tamped down or packed down, any excess sand is then removed or swept away, leaving a patch of asphalt in which at least the upper porous surface thereof has been filled with the sand.

Because the sand fills the pores, it renders the patch more resistant to climatic conditions and road conditions to enable the patch to last for a more substantial period of time than previous patching techniques.

It is to be appreciated that this type of a patch could be used on concrete potholes as like for temporary patching thereof.

In addition to patching a road in this manner, a road itself could, also, be constructed in this manner. However, because of the multiple tasks and the process employed herein, it is preferred to employ this technique as a patching technique rather than a road construction technique, although nothing impairs the use of same for such purpose.

It is to be appreciated from the preceding that there has been described herein a method for repairing a road wherein the patch is easily applied and is durable.

Having, thus described the invention, what is claimed is:

1. A method for patching an opening in a road which comprises:

a. removing any debris from the opening;

b. placing a quantity of a liquid adhesive consisting essentially of an oil-based adhesive in the opening and on the area of the road surrounding the opening;

c. depositing a quantity of asphalt in the opening and on the adhesive on the area of the road about the periphery of the opening to create a mound;

d. packing the asphalt down into the hole and onto the peripheral area;

e. applying a quantity of uncoated sand over the packed-down asphalt mound;

f. packing the sand down into the packed asphalt; and g. thereafter removing any excess sand, and wherein the method is carried out at ambient conditions.

2. The method of claim 1 wherein the road is an asphalt road.

3. The method of claim 1 wherein the road is a concrete road.

4. A method for manufacturing a road surface which comprises:

a. applying a layer of a liquid adhesive consisting essentially of an oil-based adhesive to a road bed;

b. applying a quantity of asphalt thereover;

c. compressing the asphalt into a layer thereof;

d. applying a layer of uncoated sand over the asphalt; and e. compressing the sand into the asphalt, and wherein the process is carried out at ambient conditions.

* * * * *